US005273285A

United States Patent [19]

Long

[11] Patent Number: 5,273,285

[45] Date of Patent: Dec. 28, 1993

[54] GOLF TEEING MAT

[76] Inventor: Steven K. Long, 379 Euclid Ave., Oakland, Calif. 94610

[21] Appl. No.: 670,961

[22] Filed: Mar. 18, 1991

Related U.S. Application Data

[63] Continuation-in-part of Ser. No. 592,123, Oct. 3, 1990, abandoned.

[51] Int. Cl.[5] ..... A63B 69/36

[52] U.S. Cl. ..... 273/195 A; 273/176 J; 273/187.1

[58] Field of Search ..... 273/195

[56] References Cited

U.S. PATENT DOCUMENTS

| | | | |
|---|---|---|---|
| 2,515,847 | 7/1950 | Winkler | 273/176 J |
| 3,101,949 | 8/1963 | Williams | 273/195 R X |
| 3,423,096 | 1/1969 | Tone | 273/195 A |
| 3,459,107 | 8/1969 | Anderson et al. | 273/195 A |
| 3,524,649 | 8/1970 | Conklin et al. | 273/195 R X |
| 4,871,175 | 10/1989 | Levin et al. | 273/DIG. 1 |
| 4,913,442 | 4/1990 | Walker | 273/195 A |
| 4,932,663 | 6/1990 | Makar | 273/195 A |
| 4,955,611 | 9/1990 | Moller | 273/195 A |
| 5,026,580 | 6/1991 | Hammon | 273/195 A X |
| 5,028,052 | 7/1991 | Miller | 273/195 A X |

FOREIGN PATENT DOCUMENTS

| | | | |
|---|---|---|---|
| 2095564 | 10/1982 | United Kingdom | 273/195 A |

*Primary Examiner*—George J. Marlo.

[57] ABSTRACT

A golf ball teeing mat comprising:

a. a resilient horizontally disposed sheet, b. a resilient cushion, positioned under said sheet, generally continuous in the direction of hitting, c. an artificial turf affixed atop said sheet, said turf generally coextensive with said sheet, an adhesive forming a bond between said sheet and said turf, said bond having no substantial gaps, d. a concave trough formed by manual flexing of said mat, said trough having a first point where said sheet descends below horizontal and a second point where said sheet returns to horizontal, said trough having a distance between said first and second points of 8 inches or greater, said sheet being stiff enough and said cushion being soft enough to create said trough at generally any location along the upper surface of the mat sufficiently spaced from the edges thereof to permit the formation of the trough.

6 Claims, 2 Drawing Sheets

GOLF TEEING MAT

This is a continuation-in-part of Ser. No. 592,123 filed Oct. 3, 1990 (now abandoned).

BACKGROUND

1. Field of the Invention

This invention relates generally to golf, specifically to mats which are used for teeing golf balls.

2. Description of Prior Art

Golf balls are ordinarily hit off grass turf, but during practice at the driving range and sometimes on the golf course when turf conditions are bad it is common to hit balls from a mat. Golf clubs scrape or cut turf from the ground and the golfer's feet destroy the turf when the same spot is used over and over. Consequently, small or heavily-used driving ranges employ mats to provide hitting and standing surfaces that withstand concentrated use.

Some mats are only for standing on—stance mats—while others are for club contact—teeing mats. Some serve both functions.

Heretofore, mats have been plagued by a number of problems. Some mats snag and decelerate a clubhead to an unacceptable degree, even completely stopping a clubhead. This sometimes causes injury to the golfer. The cause of snagging is not today's short-bristled artificial turf per se, but the way it is mounted and the way it delaminates. When artificial turf delaminates or separates from the layer below it, it can wrinkle in front of an impacting clubhead and snag the clubhead. A strong blow eventually rips the delaminated portion. This occurs on the large mats that are popular today.

Another problem is bouncing of the clubhead off the mat. Poplular mats have no cushioning or a very high spring rate of cushioning. On real turf, a clubhead cuts through the grass and soil. The clubhead is supposed to strike the turf after hitting the ball. Mats bounce the clubhead when the golfer swings with the downward stroke used on real turf. Consequently, golfers often adjust their swings to give a glancing blow to the mat instead of hitting down into it. This adjusted swing is not providing practice of the swing that most golfers want to use on the course, nor is the adjusted swing easy to produce. To avoid contact with the mat, overadjustment of the swing leads to millions of ruined shots and damaged balls where the sharp lower edge of the clubhead hits the ball first. Moreover, if a clubhead hits behind the ball on real turf, the golfer is penalized by loss of distance and poor contact with the ball. On a mat, a bounce of the clubhead off the mat behind the ball can result in a solid hit without the golfer's awareness of the bounce. If this mistake recurs without correction, the golfer may be unhappily suprised at the next use of real turf.

On driving ranges today, one can find basically two kinds of mats: One, a small uncushioned teeing mat of artificial turf bonded into a hard thin rubber casting which is in turn cradled in a larger hard thin rubber casting; two, a plain large mat, used for both teeing and standing, made of artificial turf with about 1.9 cm (¾ inch) of dense foam (having a 50% compression deflection of around 700 to 1400 grams/sq. cm (10 to 20 Lbs/psi)) bonded under it, with a net or scrim interface bonded between the two layers. A large plain mat with cushioning deflects perhaps 0.25 cm (0.1 inch) under a weight of 5.45 kgrams (12 lbs). A small uncushioned mat with a rubber base virtually does not deflect (except among the bristles of its artificial turf). Both types bounce a descending clubhead, and both delaminate. The large cushioned mats delaminate in spot after spot, wrinkle, snag the clubhead, and soon rip on a regular schedule.

The large mats have a special undesirable feature. Even when hitting from a spot that has not yet delaminated, a very short-lived but intense deceleration of the clubhead takes place when the clubhead tries to descend below the bristle level of the mat. This deceleration not only feels unnatural and wears out the mat, it also masks the feeling of the ball compressing against the clubface, thereby reducing the golfer's pleasure and feedback regarding solidity of the hit.

Mats usually have a hole for a common rubber tee to be inserted from below and on which a ball is placed so that a special shot, the drive, may be made. The rubber tee elevates the ball above the mat surface. Rubber tees wear too quickly because they get pinched against the mat.

Golfers consistently berate golf practice mats. Driving range operators are eager to have more durable and/or less expensive mats.

OBJECTS AND ADVANTAGES

Accordingly, several objects and advantages of the present invention are to provide a golf practice teeing mat:

(a) with a non-snagging hitting surface that does not decelerate the clubhead excessively, risking injury and damage;

(b) whose hitting surface deflects enough to allow the clubhead to move in a downward trajectory; it does not bounce the clubhead.

(c) which does not mask the feel of the ball compressing on the clubface.

(d) which does not rip or deform before it is otherwise worn out; in other words it does not delaminate.

(e) whose worn parts can easily be replaced.

(f) which is more cost effective than other mats.

(g) which does not pinch or destroy common rubber tees.

Further objects and advantages include providing a golf teeing mat which can be used for left- or right-handed golfers. Still further objects and advantages will become apparent from a consideration of the ensuing description and drawings.

DRAWING FIGURES

The following figures illustrate various embodiments and features of the present invention.

LIST OF REFERENCE NUMERALS

Figure 1:
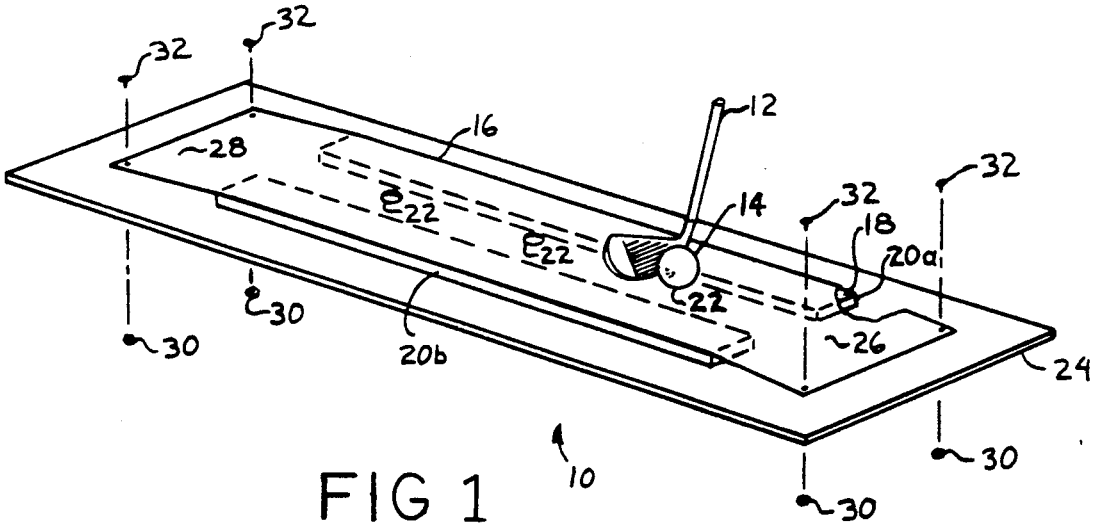
FIG. 1 shows a perspective view of a turfless golf teeing mat 10.

| FIG. 1 | |
|---|---|
| 10 teeing mat | 12 iron club |
| 14 golf ball | 16 sheet |
| 18 adhesive | 20a and 20b cushions |
| 22 ball holders | 24 base |

-continued

Figure 2:
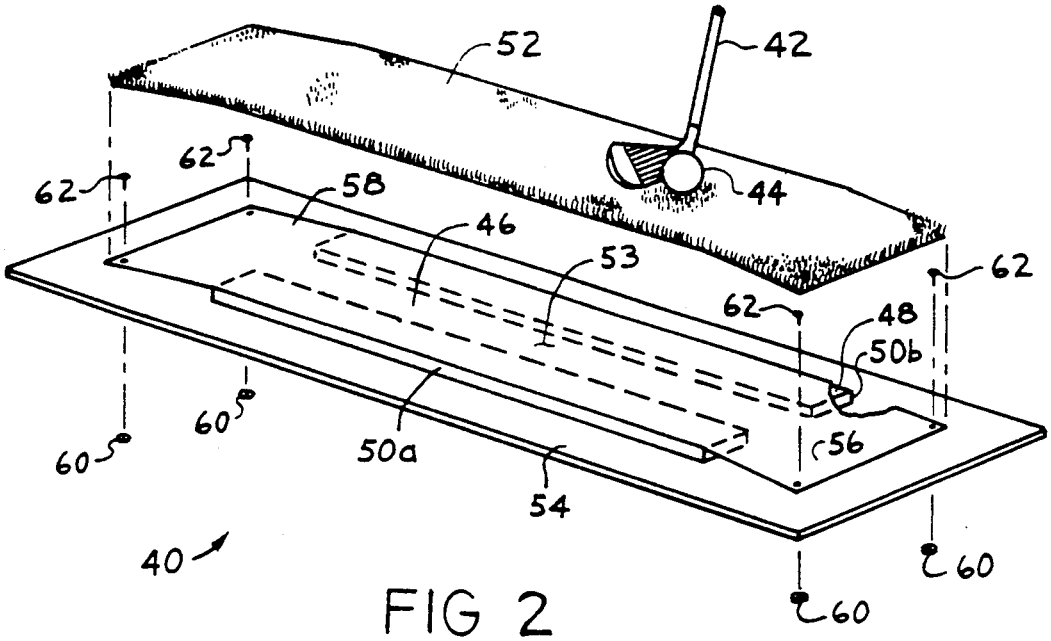
FIG. 2 shows an exploded perspective view of a golf teeing mat 40 with artificial turf.
Figure 3:
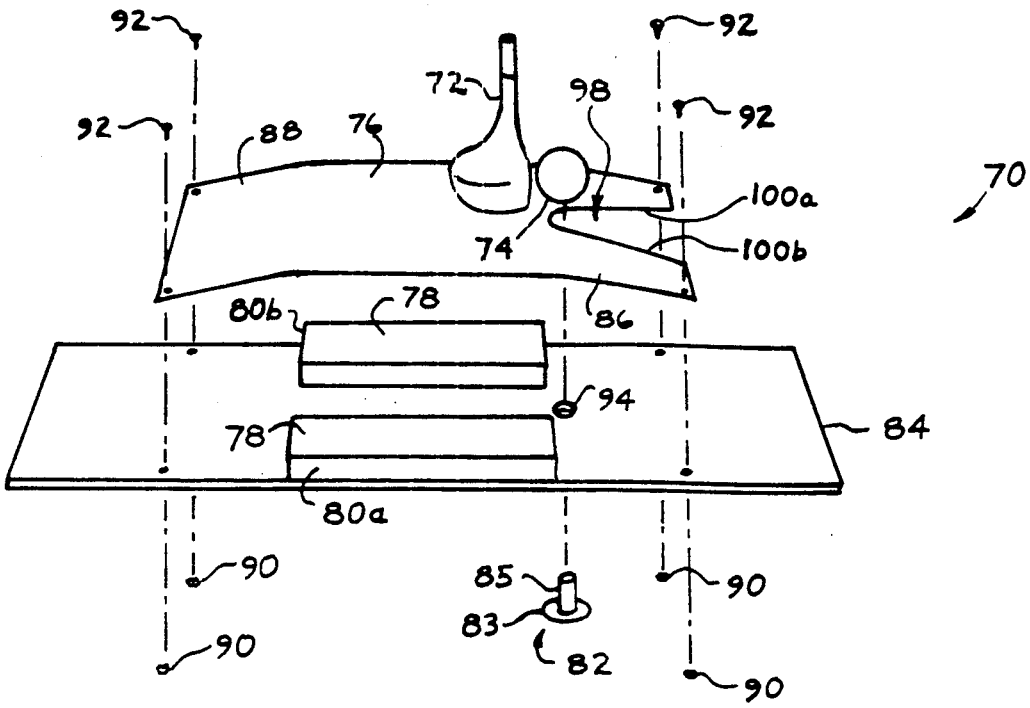
FIG. 3 shows an exploded perspective view of a turfless mat 70 for driving off a rubber tee.
Figure 4:
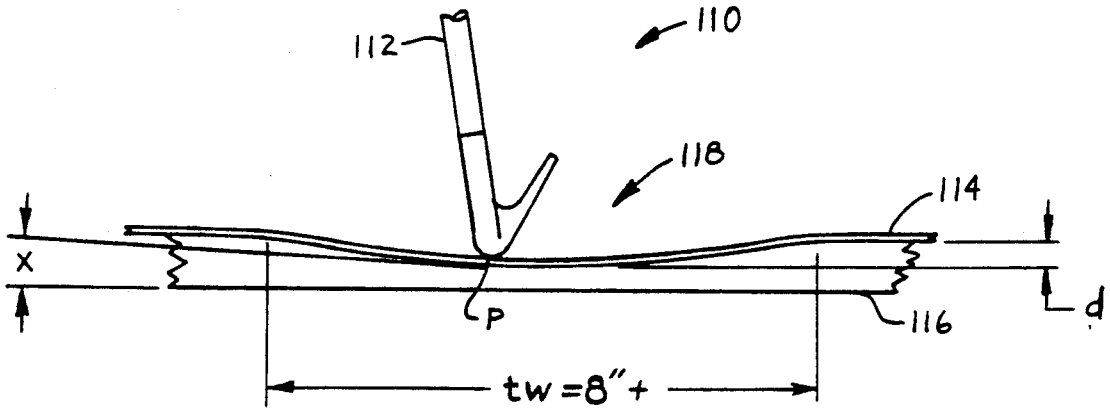
FIG. 4 shows a side view of a schematic teeing mat 110 demonstrating deflection of the mat under impact.

| | | |
|---|---|---|
| 26 first slope | 28 second slope | |
| 30 nuts | 32 bolts | |
| FIG. 2 | | |
| 40 teeing mat | 42 iron club | |
| 44 golf ball | 46 sheet | |
| 48 cushion adhesive | 50a and 50b cushions | |
| 52 artificial turf | 53 turf adhesive | 54 base |
| 56 first slope | 58 second slope | |
| 60 nuts | 62 bolts | |
| FIG. 3 | | |
| 70 teeing mat | 72 wood club | |
| 74 golf ball | 76 sheet | |
| 78 adhesive | 80a and b cushions | |
| 82 rubber tee | 83 rubber tee base | |
| 84 base | 85 stem | |
| 86 first slope | 88 second slope | |
| 90 nuts | 92 bolts | |
| 94 round hole | 98 notch | |
| 100a & b straight sides | | |
| FIG. 4 | | |
| 110 schematic teeing mat | 112 clubhead | |
| 114 sheet | 116 cushion | |
| 118 trough | P club contact point | |
| tw trough width | d depth of deflection | |
| x angle | | |

DESCRIPTION

FIG. 1—Description of Turfless Teeing Mat

Looking at FIG. 1, a teeing mat 10 of the present invention has the lower portion of a golf club iron 12 resting at address position behind a golf ball 14. Ball 14 and iron 12 rest on sheet 16 which in turn rests upon and is bonded to a pair of cushions 20*a* and 20*b* by an adhesive 18.

Sheet 16 is a thin 0.20 cm (0.080 inch), tough, resilient, abrasion-resistant, rectangular piece of plastic such as polycarbonate with length 81 cm (32 inches) and width 17 cm (6.75 inches). The flexural modulus of a common sign grade polycarbonate used for sheet 16 is 0.067 kg/sq. cm (345,000 psi) (ASTM D-790) according to the manufacturer. The rigidity of sheet 16 is a product of the flexural modulus and the area moment of inertia. The area moment of inertia is thickness cubed times width divided by 12. The rigidity is about 100 Lbs.-inches squared. General purpose high-impact ABS (acrylonitrilebutadiene-styrene) may also be used. Although ABS is not as tough, it costs less and withstands all but extreme abuse. Other plastics will no doubt work as well, if properly chosen.

The long ends of sheet 16 are bent downward at about 8 degrees from horizontal to form a first slope 26 and a second slope 28. The slopes are formed with about a 2.54 cm (1 inch) radius beginning at a distance of 10 cm (4 inches) from the respective ends. A horizontal portion of sheet 16 remains between the slopes.

Cushions 20*a* and 20*b* are stripes 1.3 cm (½ inch) thick, 61 cm (24 inches) long, and 5 cm (2 inches) wide. They are bonded under the horizontal portion of sheet 16 flush with the longitudinal edges, leaving a longitudinal center gap between the cushions. The cushions are composed of a flexible open-cell resin, such as polyurethane foam. The density of the foam is low (17 kg/cu. meter, 1.06 Lbs./cu. ft.). The pressure required to compress this foam to 50% of its resting height after about 0.5 seconds of application is 23 grams/sq cm (0.33 lbs/sq in). Other types of foam with similar characteristics may be used. Polyurethane foam is economical and effective but for outdoor use needs a coating of paint to protect exposed areas from ultraviolet light.

Sheet 16 and cushions 20*a* and 20*b* rest upon a rubber base 24. The cushions rest unbonded against rubber base 24. Sheet 16, being smaller than base 24, is centered upon base 24. Base 24 is a 0.63 cm (¼ inch) thick rectangular sheet of rubber 28 cm (11 inches) by 91 cm (36 inches). Base 24 rests on the ground or other provided surface. Base 24 is cut from floor covering material which has a corrogated surface placed facing down. The corrogations run transversly across mat 10 rather than lengthwise on the line to the target.

Sheet 16 is fastened to base 24 with nuts 30 and bolts 32, one of each in each corner of sheet 16. Bolt 32 is a flathead bolt whose head rests in a countersunk hole in sheet 16. Nut 30 is installed from below.

Ball holders 22 are provided to position a golf ball on sheet 16 prior to striking with iron 12. The ball holder is a round hole 1.6 cm (0.62 inch) in diameter which is cut or thermoformed and which either goes through sheet 16 or deeply enough into sheet 16 to clear the golf ball's bottom surface. Three such ball holders are located centrally on the sheet at 15 cm (6 inch) intervals. Ball 14 is shown sitting in one such ball holder.

FIG. 2—Description of Teeing Mat with Artificial Turf

As shown in FIG. 2, teeing mat 40 is basically the same as teeing mat 10 except for the addition of artificial turf and the absence of ball holders on the sheet. The rubber base, cushions, and fasteners are identical.

An iron club 42 and golf ball 44 are shown in address position on an artificial turf 52 which is bonded by an adhesive 53 to a sheet 46.

Artificial turf 52 is about 1.3 cm (0.5 inch) thick with rectangular dimensions matching sheet 46. It is a flexible plastic carpet made with a woven, knitted, tufted or other construction and densely packed green bristles. One manufacturer is Controlled Products in Dalton, Ga.

Turf adhesive 53 bonds the turf to sheet 46. An adhesive recommended by one skilled in the art of specifying adhesives may be tested and used. Bonding between the turf and the sheet should be complete without gaps in coverage.

Sheet 46 has the size and shape of sheet 16. It may be made from general purpose ABS with a nominal 3/32 inch (0.24 cm) thickness. General purpose ABS has a "hair-cell" or textured finish on one side which is placed facing downward to provide a smooth surface on top for bonding to turf 52. This ABS has a flexural modulus of 0.07 kg/sq.cm at 23 deg. C. (366,000 psi, 73 deg. F., ASTM D790-68T) according to the manufacturer. The rigidity of sheet 46 is 165 Lb.-inches squared.

Sheet 46 has a first slope 56 and a second slope 58 which are the same size and shape as the slopes of mat 10. Cushions 50*a* and *b* have the same size, specification, and location as those of mat 10 and are bonded by a cushion adhesive 48.

Nuts 60 and flathead bolts 62 are used to fasten the corners of sheet 46 to a rubber base 54 in the same fashion as those of mat 10. The bolt heads are hidden under turf 52.

FIG. 3—Description of Turfless Driving Mat

FIG. 3 illustrates a turfless driving teeing mat 70 which is used to drive golf balls off a common driving range rubber tee 82 installed in a hole in the mat.

A wood club 72 is shown in hitting position behind a golf ball 74. Ball 74 rests on rubber tee 82 whose stem extends above a sheet 76.

Sheet 76 is a rectangular polycarbonate sheet 41 cm (16 inches) long by 15 cm (6 inches) wide of the same polycarbonate material used in mat 10.

A pair of cushions 80*a* and *b* support sheet 76. The cushions are made of polyurethane foam with a density of 37 kg/cu. meter (2.3 Lbs./cu. foot), which is higher than that of mats 10 and 40. This foam requires a correspondingly higher pressure of 330 g/sq in or 0.72 lb/sq in to compress to 50% of its resting height. The cushions are 2.5 cm (1.0 inch) thick and 5 cm (2 inches) wide, and are centered under the sides of sheet 76 between a first bevel 86 and second bevel 88 formed at bends initiated 10 cm (4 inches) from each end of sheet 46.

Sheet 76 and cushions 80*a* and *b* are centered upon a rubber base 84 that is 24 inches long by 6 inches wide. The 0.25 inch thickness and corrogated bottom of base 84 are the same as in the previous mats.

An adhesive 78 bonds the cushions to sheet 76.

The corners of sheet 76 are fastened to base 84 by flathead bolts 92 installed from above and nuts 90 installed from below.

Rubber tee 82 is centered about 10 cm (4 inches) from the front edge of sheet 76. Rubber tee 82 has a rubber tee base 83 and a stem 85. Tee base 83 is located under mat base 84. Stem 85 extends upward through a round clearance hole 94 in base 84. Stem 85 then passes between cushions 80*a* and *b*, and then through the narrow end of a V-shaped notch 98 cut or formed in sheet 76. Notch 98 leaves some clearance around tee stem 85. The notch has sides 100*a* and *b* which diverge from each other at about 30 degrees and continue to the front edge of sheet 76.

FIG. 4—Description of Schematic Teeing Mat

FIG. 4 shows a side view of a schematic teeing mat 110 to indicate how mats 10, 40, and 70 flex during impact.

Mat 110 represents a typical appearance of a sheet 114 and a cushion 116 at one position during an impact with a clubhead 112 which is moving from right to left. The clubhead and sheet contact each other at point P.

A concave trough 118 is formed by the impact of clubhead 112. Trough 118 is oriented such that its deepest portion runs transversely to the direction of clubhead motion. The width of trough 118 is indicated by trough width tw, which runs between the top edges of the trough, where the trough meets the horizontal part of the sheet. A static trough width can be measured by manually deflecting the mat and noting the trough edges. Actual tw during impact may vary due to inertia of the moving materials.

The depth of trough 118 is indicated by a deflection d. d is the distance from the bottom of the trough to the resting level of the sheet.

Angle x is the angle of incline of sheet 114 at contact point P. The sheet rises in front of the clubhead and descends behind the clubhead.

Operation

The mats of this invention hold a ball and receive club contact, but are not for standing on. The golfer stands on a separate stance mat placed adjacently.

The golfer is allowed to use a swing that produces divots on natural turf. Adjustment of the swing to avoid hitting downward into a golf mat while practicing is no longer required. In addition, fear and risk of injury due to snagging of the clubhead are eliminated.

Mat Dynamics and the Schematic Teeing Mat of FIG. 4

The sheet of the mat transmits the force of impact of the clubhead to the cushion over a comparatively large area, compared to traditional mats.

Mats 10, 40 and 70 compress in such a way that club impact forms a trough in the sheet and cushion, as illustrated by trough 118 of FIG. 4.

Trough 118 moves with the clubhead, from right to left in FIG. 4, changing depth and location as clubhead 112 moves. Interestingly, the trough width tw on a given mat does not change. With a given cushion and sheet, trough width is constant regardless of the degree of deflection. This can be witnessed by flexing the sheet up and down by hand. How far a clubhead deflects a mat depends on the particular mat and the particular momentum and arc of the clubhead on each swing. The clubhead can stay in contact with mat 10 or 40 for 30 cm (12 inches) or more while 15 cm to 20 cm (6 to 8 inches) is common.

The clubhead forms the trough by pushing against the front of the bottom part of the trough rather than exactly at the bottom of the trough. The clubhead therefore rides against an inclined portion of the trough. Angle x indicates the incline of the sheet at the clubhead contact point. The greater angle x is, the greater the friction generated against the clubhead.

Angle x increases as mat deflection increases. Another factor that affects angle x is the trough width. A wider trough will decrease angle x on average and therefore decrease the friction of the clubhead against the mat. Reduced friction contributes to the durability of the sheet or any artificial turf bonded to it. A large trough width also creates a more natural feeling.

There is also friction against the clubhead due to the vertical opposing force of the mat which increases as the deflection of the mat increases. The vertical opposing force also increases of course as the mat is made harder to compress.

Adjustment of Mat Dynamics

The mat should at least be soft enough to not bounce a club and at least firm enough to support a club and ball during address. Within these extremes, the choice of softness can be adjusted for other reasons like durability and feel to the golfer. For example, when artificial turf is used, such as on mat 40, the friction created by the artificial turf can be adjusted higher or lower by choice of cushion and sheet, to simulate natural turf or different types of natural turf under different conditions.

Increasing sheet stiffness makes the mat harder, which increases friction and the likelihood of bouncing a clubhead, but it also increases trough width, which decreases friction after the initial impact.

Adjustment in the opposite direction reverses the effects.

Increasing cushion firmness makes the mat harder and reduces deflection, with the result of increased vertical force and friction. The club will come out of the mat sooner. Trough width is reduced by increased cushion firmness.

The trough width can be adjusted independently of mat hardness by adjusting cushion and sheet opposite to each other. For example, a softer cushion and a stiffer sheet will increase trough width.

Stiffness of the sheet is a combination of flexural modulus, width of the sheet, and thickness of the sheet.

Flexural modulus is a measure of the inherent stiffness of the material. Sheet thickness affects stiffness by a factor of the third power. Sheet width proportionately effects stiffness.

The compressability of the cushion is a combination of the spring rate of the material, thickness of the cushion, and width of the cushion. A thicker or narrower cushion is in effect softer. Using two cushions with a center gap as is done in mats 10, 40 and 70 is in effect a narrower cushion.

The compressability of cushions of the same thickness can be compared by measuring the force required to compress to 50% of resting height the cushioning that lays beneath a 2.54 cm wide rectangular area extending across the mat width. On mats 10 or 40 this force is 1.3 Lbs.

Using Two Cushions

The cushion for mats 10, 40, and 70 is a dual cushion with a center gap. By increasing the center gap, the cushion can be made softer. Another advantage of using two cushions is that the hardness of the mat on the centerline is limited to about twice the hardness at the edge, while the difference would be greater with a smaller center gap.

Operation of Slopes

Front and rear bevels on mats 10, 40, and 70 serve several functions. Primarily they produce a change of elevation of the sheet whereby the sheet can come into contact with the base for fastening. The gradualness of the slope of the slopes allows the top of the slope in the bend area to to depress easily to the base.

The rear bevel also reduces the risk of accidental impact at the rear end of the mat.

Base Operation

The corrogated rubber bases of the mats 10, 40 and 70 serve two functions. One is to keep the mats from moving forward at impact. The transverse corrogations of the base catch on irregularities in the ground, particularly under the weight of the rubber, so as to anchor the mats against forward movement. The mass of the rubber base also provides inertia against movement. A side of the base may be placed under an adjacent stance mat to further increase anchoring.

The other function of the base is to hold down the ends of the sheet from springing upward slightly as the clubhead compresses the mat.

Operation of Teeing Mat 10—FIG. 1

Teeing mat 10 can be used with either end placed forward. A golf ball is set in one of ball holders 22 and struck. A negligible amount of friction is encountered by the clubhead contact with sheet 16 since the surface of sheet 16 is smooth. There is little force to move the mat forward. Delamination and ripping of artificial turf cannot occur since there is no artificial turf. Sheet 16 wears very slowly. Hitting balls from mat 10 simulates hitting balls off a wooden tee or extremely lush natural turf wherein the clubhead meets very little resistance.

Sheet 16 can deflect a maximum of almost 1.2 cm (½ inch), compressing cushions 20*a* and *b*.

Trough width is 23 cm (9 inches) when measured statically as described above under the description of FIG. 4.

Operation of Teeing Mat with Artificial Turf, Mat 40—FIG. 2

Mat 40 has artificial turf bonded to its sheet to serve several functions. A primary function is that it looks good to the golfer and appeals to golfer expectations. Another function of artificial turf is to hold a golf ball in hitting position so the ball does not roll away. A further function of artificial turf is to provide some resistance to horizontal clubhead movement. Artificial turf, as used in mat 40, provides a friction with the clubhead which approximates the resistance of natural turf. Friction informs the golfer whether the mat or the ball has been hit first and how deeply into the mat the clubhead goes. The intensity and duration of friction increases with increasing depth of the clubhead arc.

It is imperative that artificial turf be securely bonded over its entire area so that it does not buckle or wrinkle in front of the moving clubhead and thereby snag the clubhead.

Trough width is about 28 cm (11 inches) measured as described above. The trough is larger than that of mat 10 because sheet 46 is stiffer than the sheet of mat 10, and bonding turf to a sheet adds stiffness, in an amount depending on the brand of turf.

The artificial turf, sheet, and cushions of mat 40 may be renewed as a unit without renewing the rubber base 54.

The durability of artificial turf and its bond to the sheet is improved over that of traditional mats. The sheet provides a more dimensionally stable, less penetrable surface for carrying turf than does a traditional cushioned mat, so the turf and the adhesive are less stressed. Angle x is kept low so that friction-induced stress is low. Ample mat deflection also reduces stress and friction on the turf and bond.

Deceleration never exceeds an acceptable level. Delamination which causes excessive friction or snagging does not occur.

Operation of Driving Mat, Mat 70—FIG. 3

Mat 70 is a specialized mat for driving a golf ball from a rubber tee.

A clubhead does not hit the mat surface 76 on a good shot. When surface 76 is contacted, however, the sheet and cushion flex so that no damage is done to club, sheet, or rubber tee.

Traditional mats quickly destroy rubber tees because the full force of the clubhead can pinch the rubber tee stem against a solid part of the mat. Mat 70 provides notch 98 as a gap for the tee stem to bend through so that it may avoid being pinched against the sheet while the clubhead passes over it. Notch 98 extends to the front of the sheet, creating a gap at the front of the sheet, so that topped balls cannot hit the edge of the sheet solidly.

Mat 70 uses firmer cushions than mats 10 and 40 in order to reduce mat deflection and preserve adequate space to protect tee stem 83.

The overall height of mat 70 is about 3.4 cm (1.3 inches), much the same as mat 40 so as to create equal height for adjacent use of mat 40 and 70.

The trough width of mat 70 is around 20 cm (8 inches), measured as before.

Conclusion, Ramifications, and Scope of Invention

When struck, the mats move down out of the way of the moving clubhead relatively easily in comparison to traditional mats. This easy movement includes movement far ahead of the clubhead to reduce friction and mat damage while creating a proper feel.

Thus the reader will see that the teeing mat of the invention provides a more pleasurable, productive, and safer product for the golfer and a more economical and attractive product for the driving range operator.

While the above description contains many specificities, the scope of the invention includes a broad range of other designs, only some of which have been detailed.

The turf-covered mat 40 may be altered at its front end to utilize a rubber tee for driving as found in mat 70, including a V-notch and a hole in the base like those of mat 70. The resulting combination mat, while less costly and more manageable than two separate mats, will not last as long or protect rubber tees as well as the separate dedicated mats, but may be preferred by range operators.

Cushions may be made from many materials with springing capacity.

Two or more mats of the same or different type may be placed on one base.

Length of the sheet can be altered without affecting mat dynamics. Width and height can be changed and the mat dynamics readjusted.

Artificial turf may be constructed through small holes in the sheet to create a stronger mechanical connection of turf to sheet. Fibers of artificial turf may also be bonded directly onto the top of a sheet by fusion or adhesive.

Driving mat 70 can have a small piece of extra firm foam bonded to the underside of sheet 76 behind the tee stem in the center gap to further protect the rubber tee from pinching.

If the gap between the cushions is made different at each end of the mat, a firmness option is created for users.

The pore size of the foam cushions can be adjusted to control outflow of air from the cushions to create a time-based resilience of the mat.

A wider mat may be made if sheets are placed adjacently. A single piece of artificial turf may be bonded to the adjacent sheets.

A mat may be inserted in a cutout in a stance mat. It could be attached to the stance mat by connecting a sheet with or without bevels to the stance mat at the front and back of the sheet.

The teeing mat without its cushion can be adapted for use over natural turf. Existing grass or mud acts as a cushion for the sheet.

Turf may be extended and curled over the edge of the sheet to provide a ramp for golf balls to be pulled by a clubhead onto the turf.

Accordingly, the scope of the invention should be determined not by the embodiments illustrated, but the appended claims and their legal equivalents.

I claim:

1. A golf ball teeing mat comprising:

a. a resilient horizontally disposed sheet, b. a resilient cushion, positioned under said sheet, generally continuous in the direction of hitting c. an artificial turf afixed atop said sheet, said turf generally coextensive with said sheet, a bonding means forming a bond between said sheet and said turf, said bond having no substantial gaps, d. a concave trough formed by manual flexing of said mat, said trough having a first point where said sheet descends below horizontal and a second point where said sheet returns to horizontal, said trough having a distance between said first and second points of 8 inches or greater, said sheet being stiff enough and said cushion being soft enough to create said trough at generally any location along the upper surface of the mat sufficiently spaced from the edges thereof to permit the formation of the trough.

2. The teeing mat of claim 1, further including a first slope disposed on a first end of said sheet slope angled downward and outward from said sheet, said first end being that over which a clubhead passes in the hitting direction,

3. The teeing mat of claim 2, further including a second slope disposed on a second end of said sheet, said second end opposite said first end, said second slope angled downward and outward from said sheet.

4. The teeing mat of claim 3, further including a base located under said cushion and sheet, said base connected to said slopes.

5. The teeing mat of claim 1, further including a plurality of said sheets, said sheets positioned side by side under said artificial turf, each said sheet afixed by said bonding means to said turf.

6. A golf ball teeing mat comprising:

a. a resilient horizontally disposed sheet having a flexural rigidity greater than 40 Lbs-inches-squared b. a resilient cushion located under said sheet, generally continuous in the direction of hitting, said cushion having a resistance to compression less than 4.4 Lbs. at a 50% reduction in resting height, said resistance being measured without said sheet and in an area one inch wide extending across said sheet in a direction perpendicular to the hitting direction, c. an artificial turf afixed atop said sheet, said turf generally coextensive with said sheet, a bonding means forming a bond between said sheet and said turf, said bond having no substantial gaps d. a concave trough formed by manual flexing of said mat, said trough having a first point where said sheet descends below horizontal and a second point where said sheet returns to horizontal, said sheet being stiff enough and said cushion being soft enough to create said trough at generally any location along the upper surface of said mat sufficiently spaced from the edges thereof to permit the formation of said trough.

* * * * *